US011153944B2

(12) United States Patent
Wen et al.

(10) Patent No.: US 11,153,944 B2
(45) Date of Patent: Oct. 19, 2021

(54) METHOD OF CONTROLLING LIGHT ADJUSTMENT

(71) Applicants: Guobiao Wen, Guangdong (CN); Chuqiang Tan, Guangdong (CN); Chengfeng Ruan, Guangdong (CN)

(72) Inventors: Guobiao Wen, Guangdong (CN); Chuqiang Tan, Guangdong (CN); Chengfeng Ruan, Guangdong (CN)

(73) Assignee: Zhuhai Vofan Technology Co., Ltd, Zhuhai (CN)

( * ) Notice: Subject to any disclaimer, the term of this patent is extended or adjusted under 35 U.S.C. 154(b) by 0 days.

(21) Appl. No.: 17/153,863

(22) Filed: Jan. 20, 2021

(65) Prior Publication Data

US 2021/0144819 A1 May 13, 2021

(30) Foreign Application Priority Data

Dec. 21, 2020 (CN) ..... 202011515626.8

(51) Int. Cl.
*H05B 45/10* (2020.01)
*H05B 45/325* (2020.01)

(52) U.S. Cl.
CPC ..... *H05B 45/10* (2020.01); *H05B 45/325* (2020.01)

(58) Field of Classification Search
CPC ..... H05B 45/10; H05B 45/32; H05B 45/325; H05B 47/00
See application file for complete search history.

(56) References Cited

U.S. PATENT DOCUMENTS 9,942,959 B1 * 4/2018 Zheng ..... H05B 45/20
2015/0257216 A1 * 9/2015 Lys ..... H05B 45/3725 315/201

* cited by examiner

*Primary Examiner* — Jimmy T Vu

(57) ABSTRACT

A method of controlling light adjustment include activating a power supply; activating a digital control circuit to carry out an adjustment output voltage control mode, sense a signal from a light adjustment control switching circuit, and determine a light adjustment control mode; in response to an LED power source operating in the adjustment output voltage control mode, adjusting luminance from 100% to N % and continuously adjusting luminance from N % to ≤0.01% wherein a 100% PWM signal output from a PWM driving signal circuit is unchanged, and a light adjustment signal collection circuit transmits a collected light adjustment signal having luminance between N % and ≤0.01% to the digital control circuit; in response to the LED power source operating in a PWM adjustment control mode, adjusting luminance from 100% to N % and continuously adjusting luminance from N % to ≤0.01%; and obtaining a light adjustment curve.

8 Claims, 1 Drawing Sheet

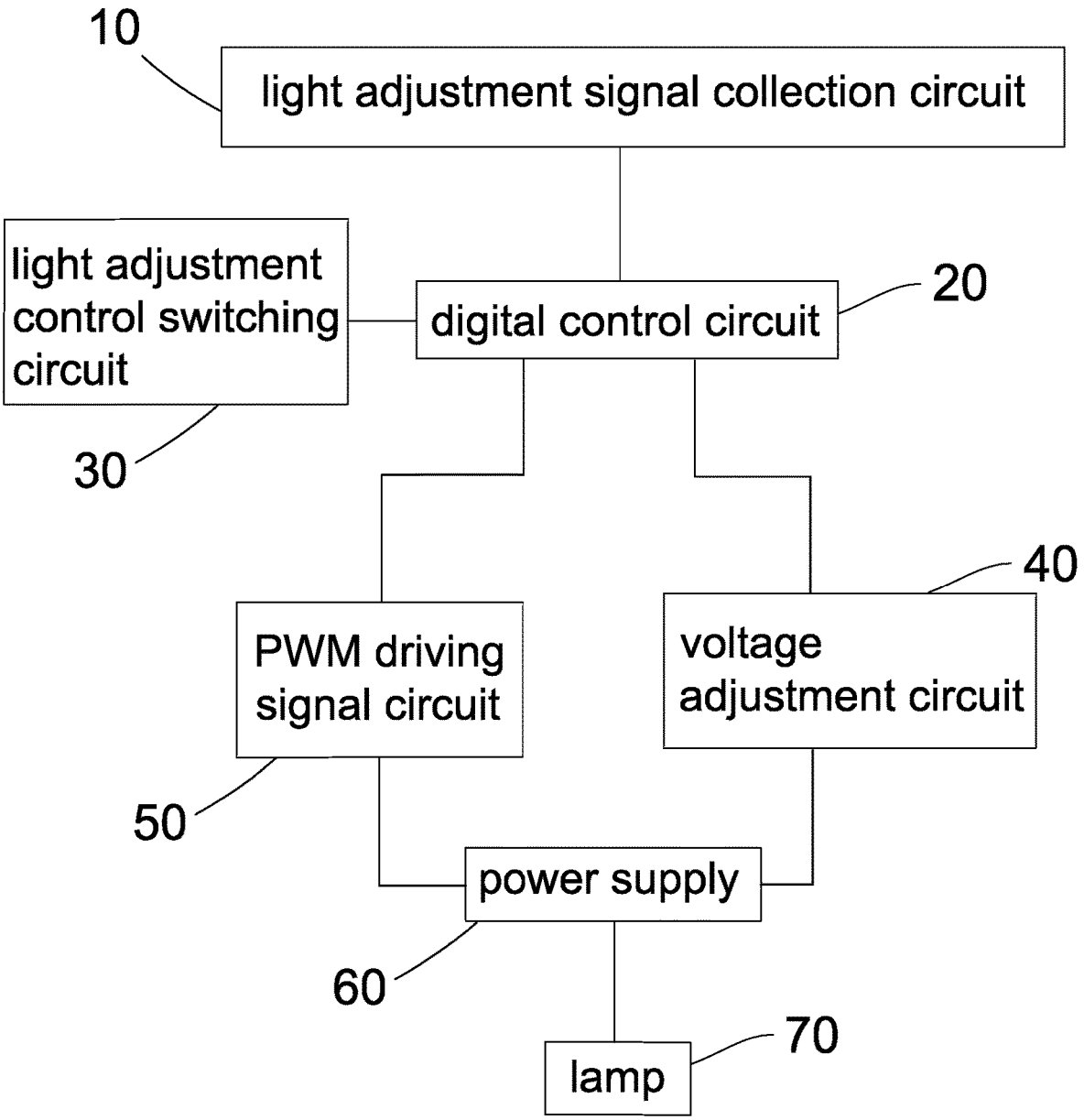
10
light adjustment signal collection circuit
light adjustment control switching circuit
digital control circuit
20
30
40
PWM driving signal circuit
voltage adjustment circuit
50
power supply
60
70
lamp

METHOD OF CONTROLLING LIGHT ADJUSTMENT

BACKGROUND OF THE INVENTION

1. Field of the Invention

The invention relates to light adjustment control of light-emitting diode (LED) power source and more particularly to a method of controlling light adjustment by switching LED power source, i.e., switching between the pulse-width modulation (PWM) adjustment control mode and the adjustment output voltage control mode.

2. Description of Related Art

An electric light is a device that produces visible light from electric current. It is the most common form of artificial lighting and is essential to modern society, providing interior lighting for buildings and exterior light for evening and nighttime activities. Common electric lights are incandescent lamps, fluorescent lamps and LED lamps.

For LED power source, PWM light adjustment mode is well known in the art. Its advantages include, by association with digital control technology, a highest light adjustment precision can be obtained with no spectrum offset. However, its disadvantages include lighting performance adversely affected by PWM frequency, frequency flash due to low frequency, unstable light adjustment, and shortened useful life due to incorrect light adjustment control mode.

Thus, the need for improvement still exists.

SUMMARY OF THE INVENTION

The invention has been made in an effort to solve the problems of the conventional art including lighting performance adversely affected by PWM frequency, frequency flash due to low frequency, unstable light adjustment, and shortened useful life due to incorrect light adjustment control mode by providing a method of controlling light adjustment by switching LED power source having novel and nonobvious characteristics.

To achieve above and other objects of the invention, the invention provides a method of controlling light adjustment comprising the steps of (1) activating a power supply; (2) activating a digital control circuit to carry out an adjustment output voltage control mode, sense a signal from a light adjustment control switching circuit, and determine a light adjustment control mode; (3) in response to an LED power source operating in the adjustment output voltage control mode, adjusting luminance from 100% to N % and continuously adjusting luminance from N % to ≤0.01% wherein a 100% PWM signal output from a PWM driving signal circuit is unchanged, and a light adjustment signal collection circuit transmits a collected light adjustment signal having luminance between N % and ≤0.01% to the digital control circuit; (4) in response to the LED power source operating in a PWM adjustment control mode, adjusting luminance from 100% to N % and continuously adjusting luminance from N % to ≤0.01%; and (5) in response to a light adjustment luminance changed from 0.01% luminance to N % luminance, obtaining a light adjustment curve in either step (3) or (4).

Preferably, in step (1) after the digital control circuit has counted the number of a signal of the light adjustment control switching circuit changed to the PWM adjustment control mode to be 10, the digital control circuit switches the light adjustment control mode to the PWM adjustment control mode; otherwise, the digital control circuit keeps the adjustment output voltage control mode unchanged, and the digital control circuit does not check the signal from the light adjustment control switching circuit.

Preferably, in step (3) condition one is when the LED power operates at the adjustment output voltage control mode, it follows a light adjustment curve of the adjustment output voltage control mode, the PWM driving signal circuit sends a 100% PWM signal, lamp luminance is controlled by the voltage adjustment circuit to be adjusted to a maximum, the 100% PWM signal outputted by the PWM driving signal circuit is unchanged, the light adjustment signal collection circuit collects the light adjustment signal having 100% luminance and sends same to the digital control circuit, after the light adjustment signal having 100% luminance has been received by the digital control circuit, the digital control circuit processes same and sends the processed light adjustment signal having 100% luminance to the voltage adjustment circuit, the voltage adjustment circuit sends a voltage adjustment signal having 100% luminance to the power supply, after the power supply has received the voltage adjustment signal having 100% luminance, the power supply supplies electricity to a lamp which emits light at maximum luminance.

Preferably, in step (3) condition two is when the light adjustment luminance changes from 100% luminance to N % luminance, the 100% PWM signal outputted by the PWM driving signal circuit is unchanged, the light adjustment signal collection circuit collects the light adjustment signal having a luminance changed from 100% luminance to N % luminance and sends same to the digital control circuit, after the light adjustment signal having a luminance changed from 100% luminance to N % luminance has been received by the digital control circuit, the digital control circuit processes same and sends the processed light adjustment signal having a luminance changed from 100% luminance to N % luminance to the voltage adjustment circuit, the voltage adjustment circuit sends a voltage adjustment signal having a luminance changed from 100% luminance to N % luminance to the power supply, after the power supply has received the outputted voltage adjustment signal having a luminance changed from 100% luminance to N % luminance, the power supply supplies electricity to the lamp, and the lamp emits light having luminance adjusted from 100% luminance to N % luminance.

Preferably, in step (3) condition three is when the light adjustment luminance changes from N % luminance to ≤0.01% luminance, the light adjustment signal collection circuit collects the light adjustment signal having a luminance changed from N % luminance to ≤0.01% luminance and sends same to the digital control circuit, after the light adjustment signal having a luminance changed from N % luminance to ≤0.01% luminance has been received by the digital control circuit, the digital control circuit processes same and then sends the processed light adjustment signal having a luminance changed from N % luminance to ≤0.01% luminance to the voltage adjustment circuit, the voltage adjustment circuit sends a voltage adjustment signal having a luminance changed from N % luminance to ≤0.01% luminance to the power supply, after the power supply has received the outputted voltage adjustment signal having a luminance changed from N % luminance to ≤0.01% luminance, the power supply supplies electricity to the lamp, the lamp emits light having luminance adjusted from N % luminance to ≤0.01% luminance.

Preferably, in step (4) condition one is when the LED power operates at the PWM adjustment control mode, it follows a light adjustment curve of the PWM adjustment control mode, the voltage adjustment circuit sends a signal having the maximum luminance, lamp luminance is controlled by the PWM driving signal circuit to be adjusted to a maximum, the light adjustment signal collection circuit collects the light adjustment signal having 100% luminance and sends same to the digital control circuit, after the light adjustment signal having 100% luminance has been received by the digital control circuit, the digital control circuit processes same and sends the processed light adjustment signal having 100% luminance to the PWM driving signal circuit, the PWM driving signal circuit sends the PWM adjustment signal having 100% luminance to the power supply, after the power supply has received the PWM adjustment signal having 100% luminance, the power supply supplies electricity to the lamp, the lamp emits light at 100% luminance.

Preferably, in step (4) condition two is when the light adjustment luminance changes from 100% luminance to N % luminance, the voltage adjustment circuit sends voltage signal having the maximum luminance, the light adjustment signal collection circuit collects the light adjustment signal having a luminance changed from 100% luminance to N % luminance and sends same to the digital control circuit, after the light adjustment signal having a luminance changed from 100% luminance to N % luminance has been received by the digital control circuit, the digital control circuit processes same and sends the processed light adjustment signal having a luminance changed from 100% luminance to N % luminance to the PWM driving signal circuit, the PWM driving signal circuit sends the PWM adjustment signal having a luminance changed from 100% luminance to N % luminance to the power supply, after the power supply has received the PWM adjustment signal having a luminance changed from 100% luminance to N % luminance, the power supply supplies electricity to the lamp, and the lamp emits light having luminance adjusted from 100% luminance to N % luminance.

Preferably, in step (4) condition three is when the light adjustment luminance changes from N % luminance to ≤0.01% luminance, the voltage adjustment circuit sends a voltage signal having the maximum luminance, the light adjustment signal collection circuit collects the light adjustment signal having a luminance changed from N % luminance to ≤0.01% luminance and sends same to the digital control circuit, after the light adjustment signal having a luminance changed from N % luminance to ≤0.01% luminance has been received by the digital control circuit, the digital control circuit processes same and sends the processed light adjustment signal having a luminance changed from N % luminance to ≤0.01% luminance to the PWM driving signal circuit, the PWM driving signal circuit sends the PWM adjustment signal having a luminance changed from N % luminance to ≤0.01% luminance to the power supply, after the power supply has received the PWM adjustment signal having a luminance changed from N % luminance to ≤0.01% luminance, the power supply supplies electricity to the lamp, and the lamp emits light having luminance adjusted from N % luminance to ≤0.01% luminance.

The method of controlling light adjustment by switching LED power source of the invention has the following advantageous effects in comparison with the prior art: Switching between the PWM adjustment control mode and the adjustment output voltage control mode with no frequency flash, reliability and precision. This enables a person to choose a best mode to control light adjustment based on properties of lamps being used. Further, it can prolong the useful life of the lamps.

The above and other objects, features and advantages of the invention will become apparent from the following detailed description taken with the accompanying drawings.

BRIEF DESCRIPTION OF THE DRAWINGS

FIG. 1 is a block diagram of the invention.

DETAILED DESCRIPTION OF THE INVENTION

Referring to FIG. 1, a method of controlling light adjustment by switching LED power source in accordance with the invention is illustrated. A first preferred embodiment of the method comprises the steps of:

S1 activating a power supply 60, and activating a digital control circuit 20 to carry out an adjustment output voltage control mode, sense a signal from a light adjustment control switching circuit 30, and determine a light adjustment control mode;

S2 in response to an LED power source operating in the adjustment output voltage control mode, adjusting luminance from 100% to N % and continuously adjusting luminance from N % to ≤0.01%, a 100% PWM signal output from a PWM driving signal circuit 50 is unchanged, and a light adjustment signal collection circuit 10 transmits a collected light adjustment signal having luminance between N % and ≤0.01% to the digital control circuit 20;

S3 in response to the LED power source operating in a PWM adjustment control mode, adjusting luminance from 100% to N % and continuously adjusting luminance from N % to ≤0.01%; and S4 in response to a light adjustment luminance changed from 0.01% (or the minimum) luminance to N % (or the maximum) luminance, a light adjustment curve in either step S2 or S3 is obtained.

A second preferred embodiment of the method comprises the steps of:

T1 activating the power supply 60, and activating the digital control circuit 20 to carry out an adjustment output voltage control mode; and T2 continuously changing the signal from the light adjustment control switching circuit 30 to the adjustment output voltage control mode until the digital control circuit 20 has counted the number of changes to be 10.

Either embodiment has the following applications: In use, the power supply 60 is activated and then the digital control circuit 20 is activated to carry out the adjustment output voltage control mode. The digital control circuit 20 continuously receives signal from the digital control circuit 20 to determine whether the digital control circuit 20 still carries out the adjustment output voltage control mode, i.e., determining the light adjustment ctrl mode. Further, a signal of the light adjustment control switching circuit 30 is changed to the PWM adjustment control mode. The signal from the light adjustment control switching circuit 30 is sensed to determine changes until the digital control circuit 20 has counted the number of changes to be 10. Thus, it is determined that the digital control circuit 20 has changed the light adjustment control mode to the PWM adjustment control mode. A voltage adjustment circuit 40 sends a voltage signal having the maximum luminance. Light adjustment linearity matches a light adjustment curve of the PWM adjustment control mode. It is noted that power of all components of the invention can be supplied by a rechargeable battery or domestic power.

The method of controlling light adjustment by switching LED power source of the invention can change the PWM adjustment control mode to the adjustment output voltage control mode or vice versa with no frequency flash, reliability and precision. This enables a person to choose a best mode to control light adjustment based on properties of lamps being used. Further, it can prolong the useful life of the lamps.

In step S1, after the digital control circuit 20 has counted the number of changes (i.e., a signal of the light adjustment control switching circuit 30 changed to the PWM adjustment control mode) to be 10, the digital control circuit 20 switches the light adjustment control mode to the PWM adjustment control mode. Otherwise, the digital control circuit 20 keeps the adjustment output voltage control mode unchanged. Thereafter, the digital control circuit 20 does not check the signal from the light adjustment control switching circuit 30.

In the step S2, condition one is detailed below. When the LED power operates at the adjustment output voltage control mode, it follows a light adjustment curve of the adjustment output voltage control mode. Also, the PWM driving signal circuit 50 sends 100% PWM signal, lamp luminance is controlled by the voltage adjustment circuit 40 to be adjusted to a maximum. The 100% PWM signal outputted by the PWM driving signal circuit 50 is unchanged. The light adjustment signal collection circuit 10 collects the light adjustment signal having 100% luminance and sends same to the digital control circuit 20. After the light adjustment signal having 100% luminance has been received by the digital control circuit 20, the digital control circuit 20 processes same and then sends the processed light adjustment signal having 100% luminance to the voltage adjustment circuit 40. The voltage adjustment circuit 40 then sends a voltage adjustment signal having 100% luminance to the power supply 60. After the power supply 60 has received the voltage adjustment signal having 100% luminance, the power supply 60 supplies electricity to a lamp (i.e., load) 70 which emits light at maximum luminance.

In the step S2, condition two is detailed below. When the light adjustment luminance changes from 100% luminance to N % luminance, the 100% PWM signal outputted by the PWM driving signal circuit 50 is unchanged. The light adjustment signal collection circuit 10 collects the light adjustment signal having a luminance changed from 100% luminance to N % luminance and sends same to the digital control circuit 20. After the light adjustment signal having a luminance changed from 100% luminance to N % luminance has been received by the digital control circuit 20, the digital control circuit 20 processes same and then sends the processed light adjustment signal having a luminance changed from 100% luminance to N % luminance to the voltage adjustment circuit 40. The voltage adjustment circuit 40 then sends a voltage adjustment signal having a luminance changed from 100% luminance to N % luminance to the power supply 60. After the power supply 60 has received the outputted voltage adjustment signal having a luminance changed from 100% luminance to N % luminance, the power supply 60 supplies electricity to the lamp 70 which emits light having luminance adjusted from 100% luminance to N % luminance.

In the step S2, condition three is detailed below. When the light adjustment luminance changes from N % luminance to ≤0.01% luminance, the 100% PWM signal outputted by the PWM driving signal circuit 50 is unchanged. The light adjustment signal collection circuit 10 collects the light adjustment signal having a luminance changed from N % luminance to ≤0.01% luminance and sends same to the digital control circuit 20. After the light adjustment signal having a luminance changed from N % luminance to ≤0.01% luminance has been received by the digital control circuit 20, the digital control circuit 20 processes same and then sends the processed light adjustment signal having a luminance changed from N % luminance to ≤0.01% luminance to the voltage adjustment circuit 40. The voltage adjustment circuit 40 then sends a voltage adjustment signal having a luminance changed from N % luminance to ≤0.01% luminance to the power supply 60. After the power supply 60 has received the outputted voltage adjustment signal having a luminance changed from N % luminance to ≤0.01% luminance, the power supply 60 supplies electricity to the lamp 70 which emits light having luminance adjusted from N % luminance to ≤0.01% luminance.

In the step S3, condition one is detailed below. When the LED power operates at the PWM adjustment control mode, it follows a light adjustment curve of the PWM adjustment control mode. Also, the voltage adjustment circuit 40 sends a signal having the maximum luminance, lamp luminance is controlled by the PWM driving signal circuit 50 to be adjusted to a maximum. The light adjustment signal collection circuit 10 collects the light adjustment signal having 100% luminance and sends same to the digital control circuit 20. After the light adjustment signal having 100% luminance has been received by the digital control circuit 20, the digital control circuit 20 processes same and then sends the processed light adjustment signal having 100% luminance to the PWM driving signal circuit 50. The PWM driving signal circuit 50 then sends the PWM adjustment signal having 100% luminance to the power supply 60. After the power supply 60 has received the PWM adjustment signal having 100% luminance, the power supply 60 supplies electricity to the lamp (i.e., load) 70 which emits light at 100% luminance.

In the step S3, condition two is detailed below. When the light adjustment luminance changes from 100% luminance to N % luminance, the voltage adjustment circuit 40 sends a voltage signal having the maximum luminance. The light adjustment signal collection circuit 10 collects the light adjustment signal having a luminance changed from 100% luminance to N % luminance and sends same to the digital control circuit 20. After the light adjustment signal having a luminance changed from 100% luminance to N % luminance has been received by the digital control circuit 20, the digital control circuit 20 processes same and then sends the processed light adjustment signal having a luminance changed from 100% luminance to N % luminance to the PWM driving signal circuit 50. The PWM driving signal circuit 50 then sends the PWM adjustment signal having a luminance changed from 100% luminance to N % luminance to the power supply 60. After the power supply 60 has received the PWM adjustment signal having a luminance changed from 100% luminance to N % luminance, the power supply 60 supplies electricity to the lamp 70 which emits light having luminance adjusted from 100% luminance to N % luminance.

In the step S3, condition three is detailed below. When the light adjustment luminance changes from N % luminance to ≤0.01% luminance, the voltage adjustment circuit 40 sends a voltage signal having the maximum luminance. The light adjustment signal collection circuit 10 collects the light adjustment signal having a luminance changed from N % luminance to ≤0.01% luminance and sends same to the digital control circuit 20. After the light adjustment signal having a luminance changed from N % luminance to ≤0.01% luminance has been received by the digital control circuit 20, the digital control circuit 20 processes same and then sends the processed light adjustment signal having a luminance changed from N % luminance to ≤0.01% luminance to the PWM driving signal circuit 50. The PWM driving signal circuit 50 then sends the PWM adjustment signal having a luminance changed from N % luminance to ≤0.01% luminance to the power supply 60. After the power supply 60 has received the PWM adjustment signal having a luminance changed from N % luminance to ≤0.01% luminance, the power supply 60 supplies electricity to the lamp 70 which emits light having luminance adjusted from N % luminance to ≤0.01% luminance.

In the step T1, the activated digital control circuit 20 continuously checks the signal from the light adjustment control switching circuit 30 to determine light adjustment control mode. The signal from the light adjustment control switching circuit 30 is determined to be PWM light adjustment control mode signal. A signal of the light adjustment control switching circuit 30 is changed to the PWM light adjustment control mode. The signal from the light adjustment control switching circuit 30 is sensed by the digital control circuit 20 to determine changes until the digital control circuit 20 has counted the number of changes to be 10. Thus, the digital control circuit 20 changes the light adjustment control mode o PWM light adjustment control mode and the voltage adjustment circuit 40 sends a voltage signal having the maximum luminance. Light adjustment linearity matches a light adjustment curve of the PWM light adjustment control mode. The light adjustment curve also follows light adjustment curve of above steps S2 and S3.

In the embodiment, the digital control circuit 20 switches the light adjustment control mode to the adjustment output voltage control mode. The PWM driving signal circuit 50 sends a PWM signal having the maximum luminance. Light adjustment linearity matches a light adjustment curve of the adjustment output voltage control mode. The light adjustment curve also follows light adjustment curve of above steps S2 and S3 until state of a next signal from the light adjustment control switching circuit 30 is changed.

Above embodiments can be combined.

While the invention has been described in terms of preferred embodiments, those skilled in the art will recognize that the invention can be practiced with modifications within the spirit and scope of the appended claims.

What is claimed is:

1. A method of controlling light adjustment, comprising the steps of:

(1) activating a power supply;

(2) activating a digital control circuit to carry out an adjustment output voltage control mode, sense a signal from a light adjustment control switching circuit, and determine a light adjustment control mode;

(3) in response to an LED power source operating in the adjustment output voltage control mode, adjusting luminance from 100% to N % and continuously adjusting luminance from N % to ≤0.01% wherein a 100% PWM signal output from a PWM driving signal circuit is unchanged, and a light adjustment signal collection circuit transmits a collected light adjustment signal having luminance between N % and ≤0.01% to the digital control circuit;

(4) in response to the LED power source operating in a PWM adjustment control mode, adjusting luminance from 100% to N % and continuously adjusting luminance from N % to ≤0.01%; and (5) in response to a light adjustment luminance changed from 0.01% luminance to N % luminance, obtaining a light adjustment curve in either step (3) or (4).

2. The method of claim 1, wherein in step (1) after the digital control circuit has counted the number of a signal of the light adjustment control switching circuit changed to the PWM adjustment control mode to be 10, the digital control circuit switches the light adjustment control mode to the PWM adjustment control mode; otherwise, the digital control circuit keeps the adjustment output voltage control mode unchanged, and the digital control circuit does not check the signal from the light adjustment control switching circuit.

3. The method of claim 1, wherein in step (3) condition one is when the LED power operates at the adjustment output voltage control mode, it follows a light adjustment curve of the adjustment output voltage control mode, the PWM driving signal circuit sends a 100% PWM signal, lamp luminance is controlled by the voltage adjustment circuit to be adjusted to a maximum, the 100% PWM signal outputted by the PWM driving signal circuit is unchanged, the light adjustment signal collection circuit collects the light adjustment signal having 100% luminance and sends same to the digital control circuit, after the light adjustment signal having 100% luminance has been received by the digital control circuit, the digital control circuit processes same and sends the processed light adjustment signal having 100% luminance to the voltage adjustment circuit, the voltage adjustment circuit sends a voltage adjustment signal having 100% luminance to the power supply, after the power supply has received the voltage adjustment signal having 100% luminance, the power supply supplies electricity to a lamp which emits light at maximum luminance.

4. The method of claim 3, wherein in step (3) condition two is when the light adjustment luminance changes from 100% luminance to N % luminance, the 100% PWM signal outputted by the PWM driving signal circuit is unchanged, the light adjustment signal collection circuit collects the light adjustment signal having a luminance changed from 100% luminance to N % luminance and sends same to the digital control circuit, after the light adjustment signal having a luminance changed from 100% luminance to N % luminance has been received by the digital control circuit, the digital control circuit processes same and sends the processed light adjustment signal having a luminance changed from 100% luminance to N % luminance to the voltage adjustment circuit, the voltage adjustment circuit sends a voltage adjustment signal having a luminance changed from 100% luminance to N % luminance to the power supply, after the power supply has received the outputted voltage adjustment signal having a luminance changed from 100% luminance to N % luminance, the power supply supplies electricity to the lamp, and the lamp emits light having luminance adjusted from 100% luminance to N % luminance.

5. The method of claim 3, wherein in step (3) condition three is when the light adjustment luminance changes from N % luminance to ≤0.01% luminance, the light adjustment signal collection circuit collects the light adjustment signal having a luminance changed from N % luminance to ≤0.01% luminance and sends same to the digital control circuit, after the light adjustment signal having a luminance changed from N % luminance to ≤0.01% luminance has been received by the digital control circuit, the digital control circuit processes same and then sends the processed light adjustment signal having a luminance changed from N % luminance to ≤0.01% luminance to the voltage adjustment circuit, the voltage adjustment circuit sends a voltage adjustment signal having a luminance changed from N % luminance to ≤0.01% luminance to the power supply, after the power supply has received the outputted voltage adjustment signal having a luminance changed from N % luminance to ≤0.01% luminance, the power supply supplies electricity to the lamp, the lamp emits light having luminance adjusted from N % luminance to ≤0.01% luminance.

6. The method of claim 1, wherein in step (4) condition one is when the LED power operates at the PWM adjustment control mode, it follows a light adjustment curve of the PWM adjustment control mode, the voltage adjustment circuit sends a signal having the maximum luminance, lamp luminance is controlled by the PWM driving signal circuit to be adjusted to a maximum, the light adjustment signal collection circuit collects the light adjustment signal having 100% luminance and sends same to the digital control circuit, after the light adjustment signal having 100% luminance has been received by the digital control circuit, the digital control circuit processes same and sends the processed light adjustment signal having 100% luminance to the PWM driving signal circuit, the PWM driving signal circuit sends the PWM adjustment signal having 100% luminance to the power supply, after the power supply has received the PWM adjustment signal having 100% luminance, the power supply supplies electricity to the lamp, the lamp emits light at 100% luminance.

7. The method of claim 6, wherein in step (4) condition two is when the light adjustment luminance changes from 100% luminance to N % luminance, the voltage adjustment circuit sends a voltage signal having the maximum luminance, the light adjustment signal collection circuit collects the light adjustment signal having a luminance changed from 100% luminance to N % luminance and sends same to the digital control circuit, after the light adjustment signal having a luminance changed from 100% luminance to N % luminance has been received by the digital control circuit, the digital control circuit processes same and sends the processed light adjustment signal having a luminance changed from 100% luminance to N % luminance to the PWM driving signal circuit, the PWM driving signal circuit sends the PWM adjustment signal having a luminance changed from 100% luminance to N % luminance to the power supply, after the power supply has received the PWM adjustment signal having a luminance changed from 100% luminance to N % luminance, the power supply supplies electricity to the lamp, and the lamp emits light having luminance adjusted from 100% luminance to N % luminance.

8. The method of claim 7, wherein in step (4) condition three is when the light adjustment luminance changes from N % luminance to ≤0.01% luminance, the voltage adjustment circuit sends a voltage signal having the maximum luminance, the light adjustment signal collection circuit collects the light adjustment signal having a luminance changed from N % luminance to ≤0.01% luminance and sends same to the digital control circuit, after the light adjustment signal having a luminance changed from N % luminance to ≤0.01% luminance has been received by the digital control circuit, the digital control circuit processes same and sends the processed light adjustment signal having a luminance changed from N % luminance to ≤0.01% luminance to the PWM driving signal circuit, the PWM driving signal circuit sends the PWM adjustment signal having a luminance changed from N % luminance to ≤0.01% luminance to the power supply, after the power supply has received the PWM adjustment signal having a luminance changed from N % luminance to ≤0.01% luminance, the power supply supplies electricity to the lamp, and the lamp emits light having luminance adjusted from N % luminance to ≤0.01% luminance.

* * * * *